US010064497B2

(12) United States Patent
Edwards et al.

(10) Patent No.: US 10,064,497 B2
(45) Date of Patent: Sep. 4, 2018

(54) ADJUSTABLE TOILET FOOTREST ASSEMBLY

(71) Applicants: Robert W. Edwards, St. George, UT (US); Judy M. Edwards, St. George, UT (US); William T. Edwards, St. George, UT (US)

(72) Inventors: Robert W. Edwards, St. George, UT (US); Judy M. Edwards, St. George, UT (US); William T. Edwards, St. George, UT (US)

(73) Assignee: Squatty Potty, LLC, St. George, UT (US)

( * ) Notice: Subject to any disclaimer, the term of this patent is extended or adjusted under 35 U.S.C. 154(b) by 0 days.

(21) Appl. No.: 15/212,509

(22) Filed: Jul. 18, 2016

(65) Prior Publication Data

US 2017/0079442 A1 Mar. 23, 2017

Related U.S. Application Data

(63) Continuation of application No. 29/539,985, filed on Sep. 18, 2015, now Pat. No. Des. 767,291.

(60) Provisional application No. 62/350,254, filed on Jun. 15, 2016.

(51) Int. Cl.

| | |
|---|---|
| ***A47C 16/02*** | (2006.01) |
| ***A47C 9/00*** | (2006.01) |
| ***A47K 17/02*** | (2006.01) |

(52) U.S. Cl.
CPC ..... *A47C 16/025* (2013.01); *A47C 9/00* (2013.01); *A47K 17/028* (2013.01)

(58) Field of Classification Search
USPC ..... 4/254
See application file for complete search history.

(56) References Cited

U.S. PATENT DOCUMENTS

| | | | | |
|---|---|---|---|---|
| 4,678,234 | A * | 7/1987 | Wilson | A47C 16/025 297/423.45 |
| 2009/0145340 | A1* | 6/2009 | Parvizian | A47C 16/02 108/137 |
| 2012/0255108 | A1* | 10/2012 | Litchmore | A47K 17/028 4/254 |
| 2013/0174337 | A1* | 7/2013 | Fagre | A47K 17/028 4/254 |

* cited by examiner

*Primary Examiner* — Lauren Crane
(74) *Attorney, Agent, or Firm* — Gurr & Brande, PLLC; Robert A. Gurr

(57) ABSTRACT

An adjustable toilet footrest assembly has a main footrest and a height-adjusting accessory, wherein the height-adjusting accessory is removably attachable to the top of the main footrest and wherein the height-adjusting accessory is nestable to the underside of the main footrest when not in use.

5 Claims, 10 Drawing Sheets

ADJUSTABLE TOILET FOOTREST ASSEMBLY

CROSS-REFERENCE TO RELATED APPLICATIONS

This application is a continuation of U.S. Design patent application Ser. No. 29/539,985, filed on Sep. 18, 2015, and further claims the benefit of U.S. Provisional Application Ser. No. 62/350,254, filed on Jun. 15, 2016, both of which are incorporated herein by reference.

TECHNICAL FIELD

The present disclosure relates to footrests. More specifically, the present disclosure relates to adjustable toilet footrests for use while on a toilet.

BACKGROUND

Humans can perform defecation in different postures; the two most common are squatting or sitting positions. The squatting posture is usually used when using a squat toilet (mainly a feature of the developing world), or when toilets are unavailable. The sitting posture during defecation is a standard posture seen in the western world because western-style toilets usually require a sitting position with the back erect and the knees away from the chest in about a ninety-degree angle.

The anorectal angle, which is the angle formed in the colon where the puborectalis muscle wraps around the rectum, is a very important factor in maintaining continence. The sitting posture common to western-style toilets causes a narrowing of the anorectal angle and prevents the puborectalis muscle from relaxing, which may cause difficulty in emptying the bowels.

Additionally, the sitting position may cause the person to repeat the Valsalva maneuver, i.e., exhalation against a closed airway to increase internal pressure, holding his breath to increase internal pressure, which can lead to syncope. A sitting posture may increase issues related to weakness in the colon wall because of the increased straining needed to defecate.

In contrast, the squatting defecation posture involves squatting by standing with the knees and hips sharply bent and the buttocks suspended near the ground. By using the squatting defecation posture, the anorectal angle is increased, which allows the puborectalis muscle to fully relax, which aids defecation by reducing the amount of effort needed to empty the bowels.

The advantages of the squatting position may be obtained when using western-style toilets (i.e., where the bowl is raised from the ground and is intended for sitting as opposed to squatting) in conjunction with a footrest. Footrests help raise the knees toward the chest and help to lessen the normal sitting angle of about ninety-degrees to much less. As the feet are raised, the puborectalis muscle relaxes, the colon aligns allowing gravity to aid evacuation, and the required expulsive effort lessens. As such, several footrests exist in the art that are aimed at allowing a human to achieve a better anorectal angle while sitting on a toilet.

However, users come in a variety of sizes and shapes. Taller people need a different height of footrest than shorter people to achieve the desired anorectal angle. Further, many people need to adjust the height or angle of the toilet footrest due to certain medical restrictions or conditions that may inhibit their ability to fully squat. Children may also require different heights than adults. As such, there remains a need for a toilet footrest that is easily adjustable to different heights and angles so as to accommodate users of all sizes and medical needs. The present invention seeks to solve these and other problems.

SUMMARY OF EXAMPLE EMBODIMENTS

The present disclosure is directed to an adjustable toilet footrest while using a toilet. In one embodiment, an adjustable toilet footrest assembly comprises a main footrest and a height-adjusting accessory, wherein the height-adjusting accessory is removably attachable to the top of the main footrest and wherein the height-adjusting accessory is nestable to the underside of the main footrest when not in use.

In one embodiment, an adjustable toilet footrest assembly comprises a main footrest and a height- and angle-adjusting accessory, wherein the height- and angle-adjusting accessory is removably attachable to the top of the main footrest and wherein the height- and angle-adjusting accessory is nestable to the underside of the main footrest when not in use.

DETAILED DESCRIPTION OF EXAMPLE EMBODIMENTS

Figure 1:
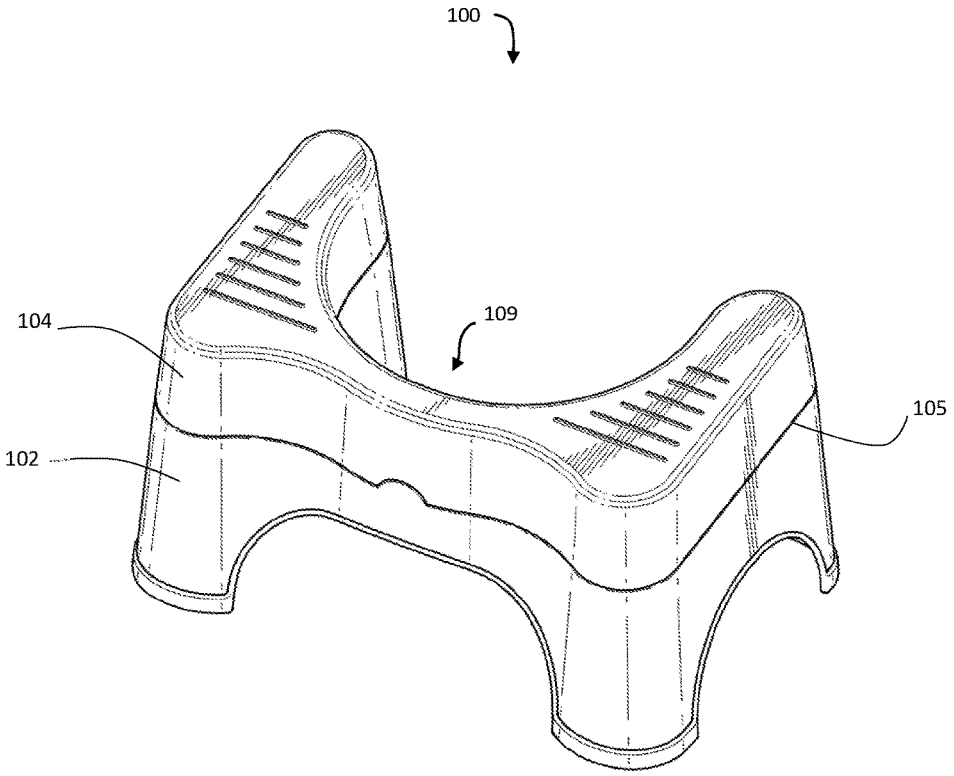
FIG. 1 is a front perspective view of an adjustable toilet footrest assembly.

The following descriptions depict only example embodiments and are not to be considered limiting in scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to the drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various different sequences and arrangements while still falling within the scope of the present invention.

The term "coupled" may mean that two or more elements are in direct physical contact. However, "coupled" may also mean that two or more elements are not in direct contact with each other, but yet still cooperate or interact with each other.

The terms "comprising," "including," "having," and the like, as used with respect to embodiments, are synonymous, and are generally intended as "open" terms (e.g., the term "including" should be interpreted as "including, but not limited to," the term "having" should be interpreted as "having at least," the term "includes" should be interpreted as "includes, but is not limited to," etc.).

As disclosed herein, an adjustable toilet footrest assembly allows for adjustments of the height and/or angle of the foot platform (where a user rests his/her feet) in order to conform to a user's individual needs. An adjustable toilet footrest assembly allows the user to obtain the correct anorectal angle to approximate a squatting position that cannot otherwise be obtained using a static or non-adjustable footrest. Users who are the same height may not require the same height setting to obtain the correct anorectal angle using the footrest because one user's legs may be longer or shorter than the other user's legs. Users of different heights also require different heights of a footrest to achieve the desired angle. Therefore, the adjustable toilet footrest assembly disclosed herein allows the average user, as well as the non-average user, to obtain a better approximation of the squatting position and thus a better anorectal angle in order to defecate.

Figure 2:
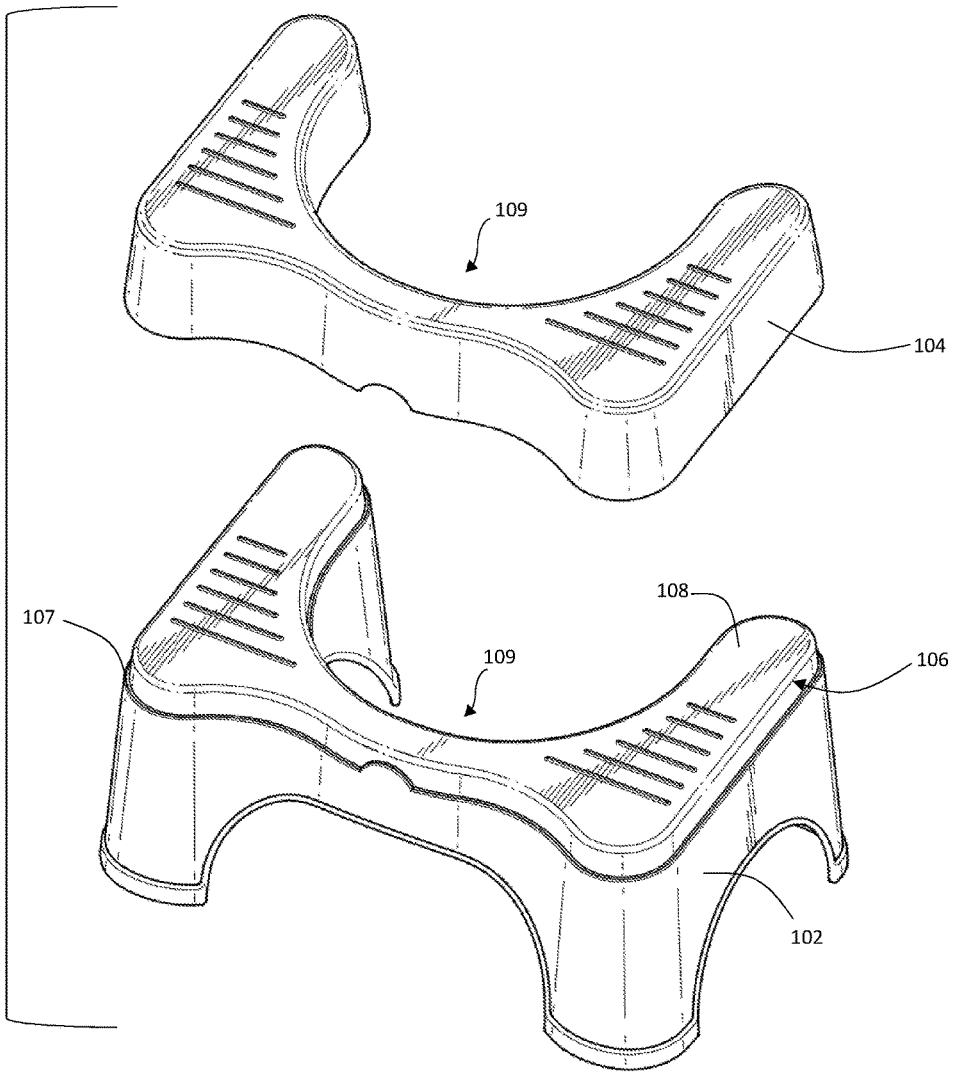
FIG. 2 is a front perspective view of an adjustable toilet footrest assembly having a height-adjusting accessory disconnected from the main footrest.
Figure 12:
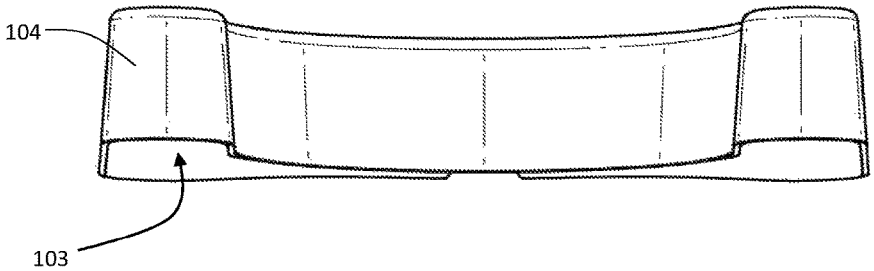
FIG. 12 is a back elevation view of a height-adjusting accessory for an adjustable toilet footrest assembly.
Figure 13:
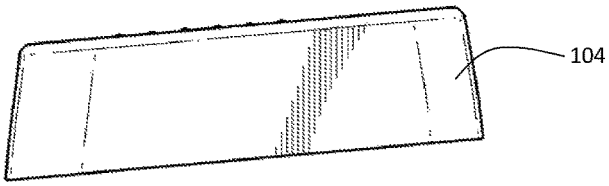
FIG. 13 is a side elevation view of a height-adjusting accessory for an adjustable toilet footrest assembly.
Figure 14:
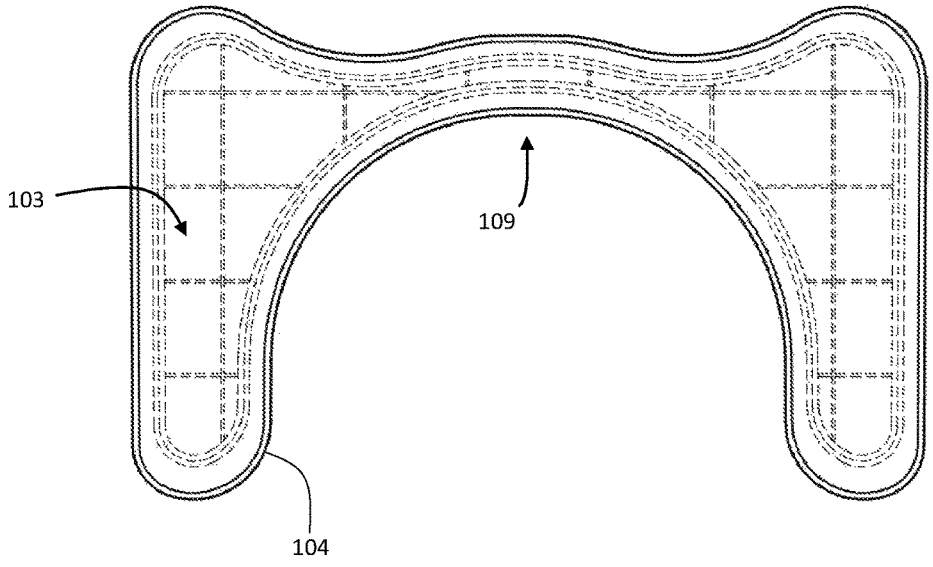
FIG. 14 is a bottom plan view of a height-adjusting accessory for an adjustable toilet footrest assembly.

Referring now to what is generally illustrated in FIG. 1, an adjustable toilet footrest assembly 100 comprises a main footrest 102 and a height-adjusting accessory 104, wherein the height-adjusting accessory 104 is removably attachable to the top of the main footrest 102. For example, as shown in FIG. 2, the main footrest 102 has a recessed upper-edge 106 that forms main foot platform 108, the main foot platform 108 being receivable within a complementary aperture 103 (best seen in FIGS. 12 and 14) on the underside of the height-adjusting accessory 104. Referring back to FIG. 1, when the height-adjusting accessory 104 is coupled to the main footrest 102, the sidewalls of each are generally aligned, such that one does not overlap the other, creating a line 105 around the circumference of the adjustable toilet footrest assembly 100 when fully coupled. In other words, the sidewalls of the height-adjusting accessory 104 fit over the main foot platform 108, where the sidewalls then rest on the ledge 107 (see FIG. 2) created by the recessed upper-edge 106.

Figure 3:
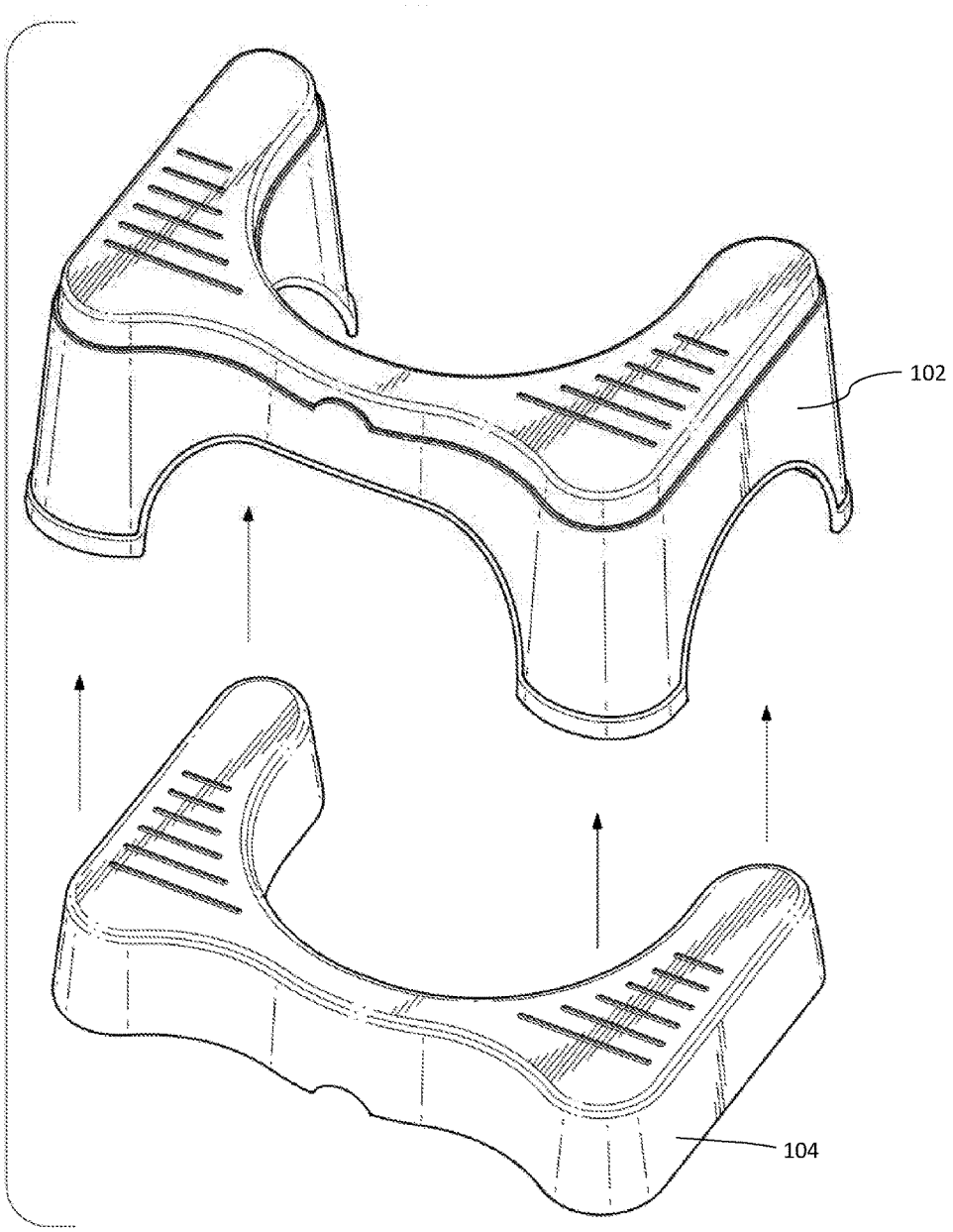
FIG. 3 is a front perspective view of an adjustable toilet footrest assembly having a height-adjusting accessory disconnected from the main footrest and illustrating the nesting direction with the main footrest.
Figure 4:
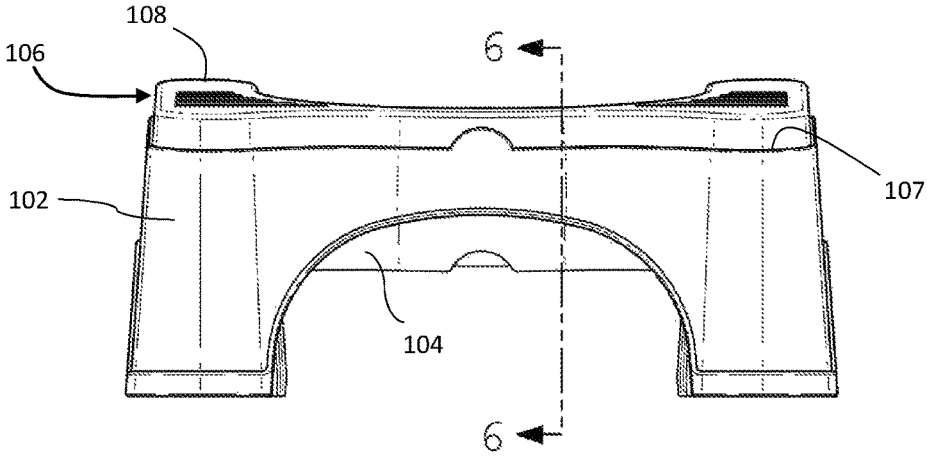
FIG. 4 is a front elevation view of an adjustable toilet footrest assembly with the height-adjusting accessory nested within the underside of the main footrest.
Figure 5:
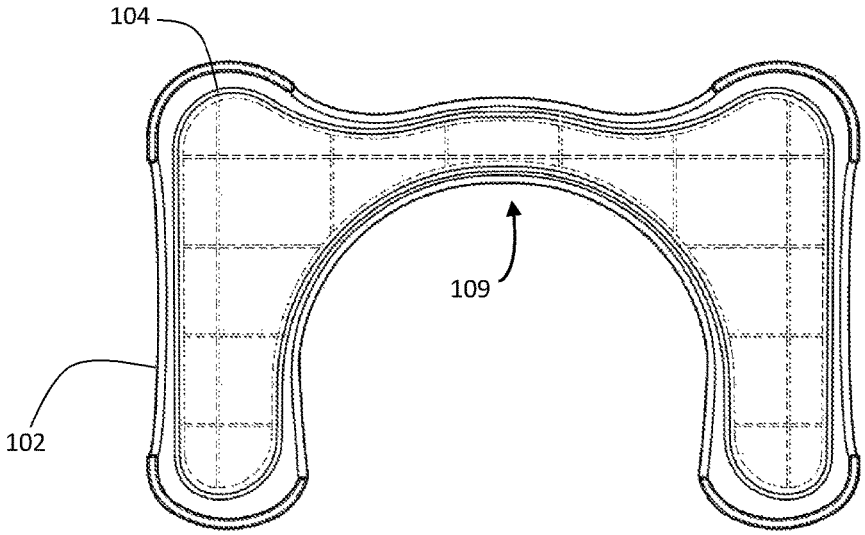
FIG. 5 is a bottom plan view of an adjustable toilet footrest assembly wherein a height-adjusting accessory is nested within the main footrest.
Figure 6:
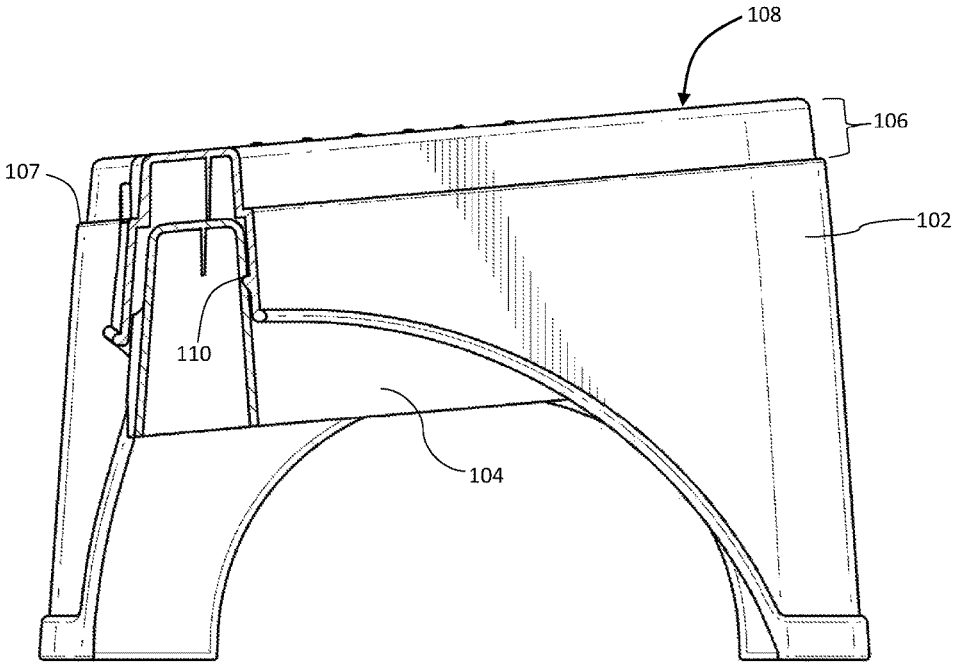
FIG. 6 is a sectional view along the line in FIG. 4 of an adjustable toilet footrest assembly wherein a height-adjusting accessory is nested within the main footrest.
Figure 7:
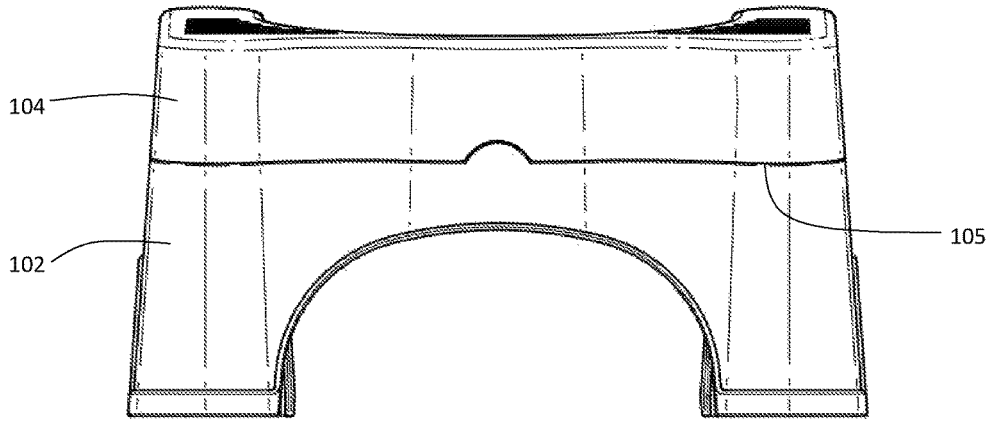
FIG. 7 is a front elevation view of an adjustable toilet footrest assembly with a height-adjusting accessory coupled to the top of the main footrest.
Figure 8:
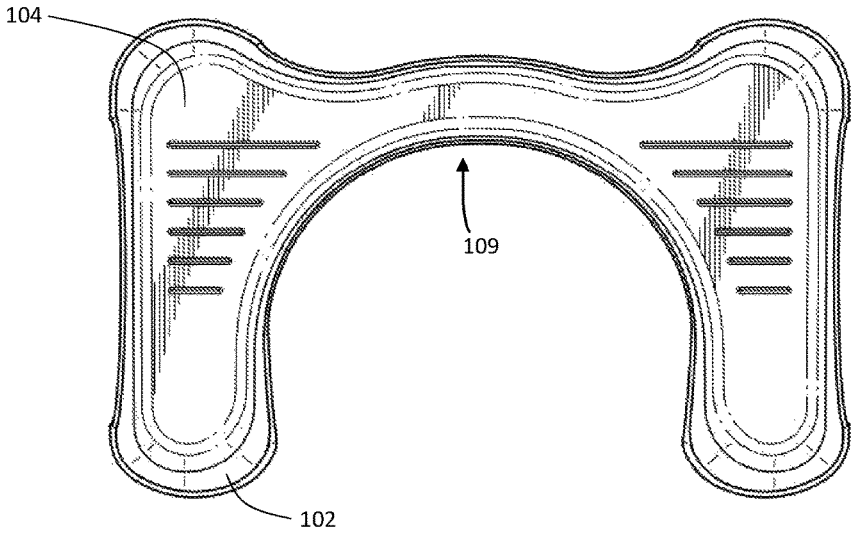
FIG. 8 is a top plan view of an adjustable toilet footrest assembly with a height-adjusting accessory coupled to the top of the main footrest.
Figure 9:
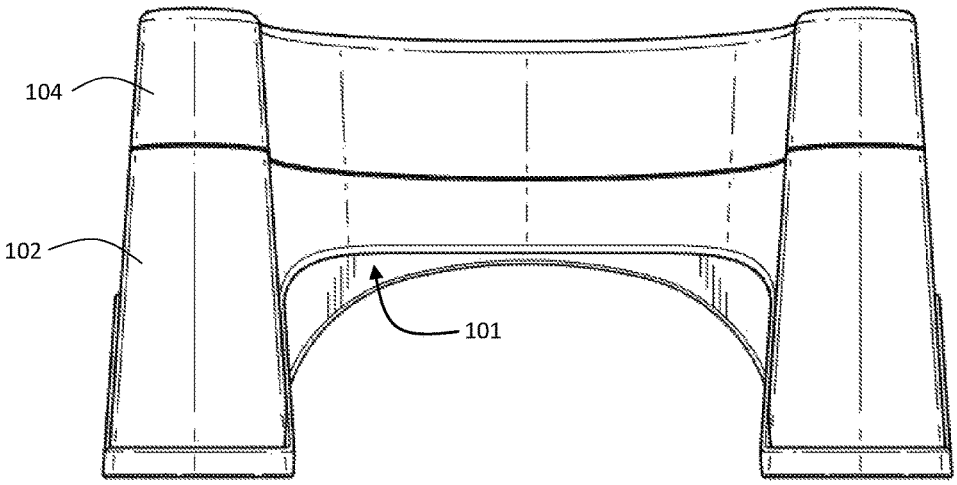
FIG. 9 is a back elevation view of an adjustable toilet footrest assembly with a height-adjusting accessory coupled to the top of the main footrest.
Figure 11:
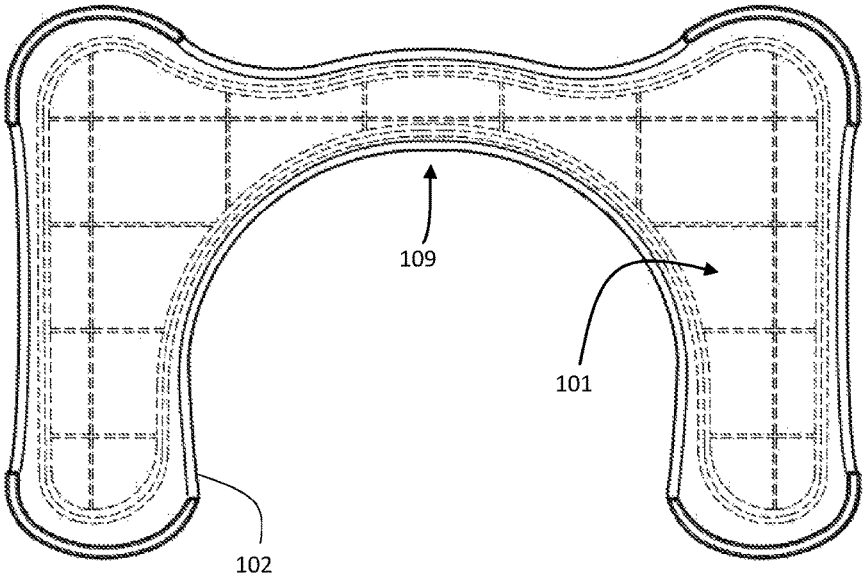
FIG. 11 is a bottom plan view of a main footrest of an adjustable toilet footrest assembly without a height-adjusting accessory nested therein.

Referring to FIG. 3, the height-adjusting accessory 104 is sized so as to nest within the underside of the main footrest 102. In other words, height-adjusting accessory 104 is shaped and sized so as to be received within the underside of the main footrest 102. FIGS. 4-6 illustrate the height-adjusting accessory 104 nested within the main footrest 102 for storage. In one embodiment, the height-adjusting accessory 104 is held within the main footrest 102 using tension. In other words, the receiving aperture 101 (best seen in FIG. 11) on the underside of the main footrest 102 has a gradient (angled from the vertical axis and perhaps best shown in FIG. 8, where the angled sidewalls are visible) such that the receiving aperture 101 opening is slightly larger (i.e., greater circumference) than the portion of the receiving aperture 101 nearest the foot platform 108 (i.e., smaller circumference). As such, the height-adjusting accessory 104 is easily insertable into the receiving aperture 101 opening of the main footrest 102, wherein a user may then apply pressure to force the height-adjusting accessory 104 towards the underside of the foot platform 108, causing it to be held in place by tension (i.e., the main footrest 102 and height-adjusting accessory 104 nest together with friction between the sidewalls, creating enough tension so that the height-adjusting accessory 104 remains suspended from within the main footrest 102). If a user desires to remove the height-adjusting accessory 104, the user may grasp an edge or sidewall of the height-adjusting accessory 104 and withdraw it, using a slight force, from the underside of the main footrest 102.

In one embodiment (as best seen in FIG. 6), the receiving aperture 101 in the main footrest 102 for receiving the height-adjusting accessory 104 may have one or more protrusions 110 for creating additional tension or for interlocking with the height-adjusting accessory 104 (i.e., tongue and groove configuration). For example, the height-adjusting accessory 104 may have one or more grooves for receiving the protrusions 110. This allows the height-adjusting accessory to remain suspended from the bottom of the main footrest 102. A user could simply flex the main footrest 102 to release the protrusions from the grooves and thereby withdraw the height-adjusting accessory. Other configurations for nesting and suspending the height-adjusting accessory 104 within the main footrest 102 may also be used. For example, spring-loaded locking pins, cotter pins, straps, or other methods may be employed without departing herefrom.

In one embodiment, the height-adjusting accessory may comprise snaps, hooks and loops (e.g., Velcro®), or other coupling mechanisms meant to aid in coupling the height-adjusting accessory to the main footrest. In such embodiments, the main footrest need not have a recessed upper edge since the height-adjusting accessory could merely attach to the foot platform using the snaps or hooks and loops. For example, the height-adjusting accessory may snap to the top of the main footrest, without need of the foot platform of the main footrest to be received within the height-adjusting accessory. In such an embodiment, the height-adjusting accessory need not have an aperture 103. In another variation, the height-adjusting accessory may have one or more guide rods extending downward for insertion into complementary guide-rod receiving slots in the main footrest. Likewise, this would prevent the height-adjusting accessory from moving horizontally while mounted on the top of the main footrest.

Figure 10:
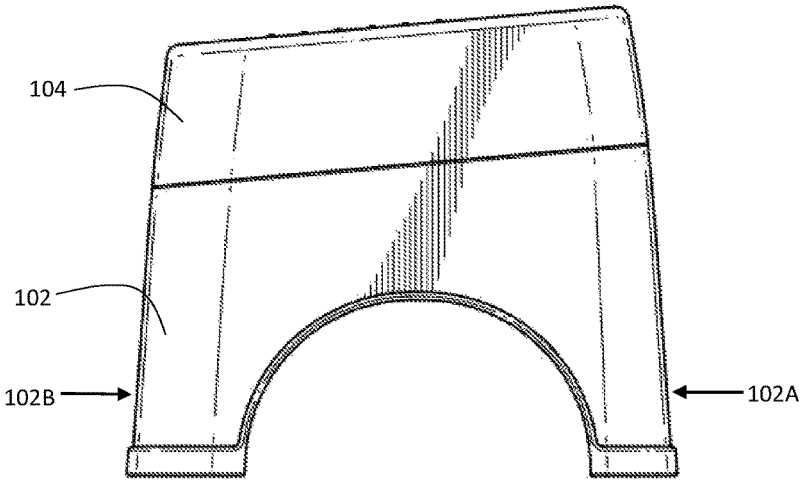
FIG. 10 is a side elevation view of an adjustable toilet footrest assembly with a height-adjusting accessory coupled to the top of the main footrest.

In one embodiment, an adjustable toilet footrest assembly comprises a main footrest and a height- and angle-adjusting accessory, wherein the height- and angle-adjusting accessory is removably attachable to the top of the main footrest (as previously described herein), and wherein the height- and angle-adjusting accessory is nestable to the underside of the main footrest when not in use. As an example, the height- and angle-adjusting accessory may be very similar to that disclosed in FIGS. 12-16, but could further comprise a first end (e.g., proximal to the toilet) greater in height than the distal end, creating a sloped foot platform. For example, as perhaps best shown in FIG. 10, the main footrest 102 has a proximal end 102A greater in height than the distal end 102B, placing its foot platform at an angle relative to the floor. As such, when the height-adjusting accessory 104 or height- and angle-adjusting accessory is placed thereon, the user's feet remain comfortably angled. However, the height- and angle-adjusting accessory could be of many configurations; for example, the angle of the height- and angle-adjusting accessory could be opposite that of the main footrest 102, creating a non-angled foot platform, should a user desire. Briefly, the term "foot platform" is used herein to describe the portion of the main footrest or accessory where a user rests their feet. If the accessory is not coupled to the main footrest 102, a user will place their feet on its foot platform 108. If an accessory is coupled to the main footrest 102, a user will rest their feet on the foot platform of the accessory. Other users may desire an even greater angle, so the height- and angle-adjusting accessory could be angled similarly to the main footrest 102, which would create an even greater angled surface for the user to rest their feet. It will be appreciated that any number of angled combinations and heights may be used without departing herefrom. Further, it will be appreciated that the main footrest 102 need not be angled relative to the horizontal axis.

The adjustable toilet footrest assembly may be made from a variety of materials, such as rubbers, silicones, plastics, high-density polyethylene, carbon fibers, metals, woods, or other materials that allow for shape, durability, and strength. It will be noted that the material should be strong enough for a user to rest their feet thereon—the footrest does not need to support the full weight of a person. The Figures illustrate one embodiment made from formed plastic (e.g., injection molded). The foot platform has sidewalls that extend downwardly therefrom and that come into contact with the ground so as to elevate and/or angle the foot platform. While this configuration is shown, it will be appreciated that other configurations and methods of manufacture are possible without departing herefrom. Semi-circular curvature 109 allows the adjustable toilet footrest assembly 100 to take up minimal space at the base of a toilet, while also allowing the user a variety of foot placements. However, while not illustrated herein, other configurations may be suitable, such as rectangular, square, semi-ovular, small cutouts to no cutouts at all, etc.

As an example of use of the embodiments described herein, a user would first adjust the height and/or angle of the foot platform, if desired, by withdrawing the height-adjusting accessory 104 from within the main footrest 102. The user would then mount the height-adjusting accessory 104 to the top of the main footrest 102 by placing it thereon, where the foot platform 108 of the main footrest 102 is received within the aperture 103 on the underside of the height-adjusting accessory 104. The user would then place the adjustable toilet footrest assembly 100 at the front of the toilet, so that, in one embodiment, it wraps around the front of the toilet. Again, while the drawings illustrate a curvature for fitting around a toilet, such design is not required. While sitting on the toilet, the user will then raise their legs and place their feet on the foot platform (i.e., either the foot platform of the main footrest 102 if no height-adjusting accessory was desired, or on the foot platform of the height-adjusting accessory 104), which creates the desired anorectal angle.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. An adjustable toilet footrest assembly, comprising:

a main footrest comprising a foot platform and sidewalls, the foot platform being recessed in relation to the sidewalls, forming a recessed upper-edge on the main footrest; and an aperture on the underside of the main footrest;

a height-adjusting accessory comprising a foot platform, sidewalls, and an aperture configured to mate with the recessed upper-edge of the main platform, wherein when the aperture of the height-adjusting accessory is mated with the recessed upper-edge of the main footrest, the sidewalls of the height-adjusting accessory and the main footrest are generally aligned; and wherein the height-adjusting accessory is receivable within the aperture on the underside of the main footrest so as to be suspended from the main footrest.

2. The adjustable toilet footrest assembly of claim 1, wherein the main footrest has one or more protrusions within the aperture configured to secure the height-adjusting accessory when received therein.

3. The adjustable toilet footrest assembly of claim 1, wherein the main footrest and the height-adjusting accessory have a semi-circular curvature on the side proximal a toilet.

4. The adjustable toilet footrest assembly of claim 1, wherein the height-adjusting accessory has an angled foot platform.

5. The adjustable toilet footrest assembly of claim 2, wherein the height-adjusting accessory has a groove for receiving the protrusions.

* * * * *